US005552754A

United States Patent [19]

Sharaf

[11] Patent Number: 5,552,754

[45] Date of Patent: Sep. 3, 1996

[54] CATCH FOR ELECTRICAL CONTACT UTILIZING ELECTROMAGNETIC FORCES

[75] Inventor: Nadir Sharaf, Mounds View, Minn.

[73] Assignee: Onan Corporation, Minneapolis, Minn.

[21] Appl. No.: 469,008

[22] Filed: Jun. 5, 1995

[51] Int. Cl.[6] ..... H01H 75/00

[52] U.S. Cl. ..... 335/16; 335/172; 335/167

[58] Field of Search ..... 335/16, 147, 195; 218/22

[56] References Cited

U.S. PATENT DOCUMENTS

| | | | |
|---|---|---|---|
| 1,516,440 | 11/1924 | Johnson . | |
| 1,720,189 | 7/1929 | Jackson . | |
| 2,306,235 | 12/1942 | Walle . | |
| 2,807,684 | 9/1957 | Ayers | 74/97.1 |
| 2,989,603 | 6/1961 | Mikos et al. . | |
| 3,246,100 | 4/1966 | Russell . | |
| 3,345,485 | 10/1967 | Engel . | |
| 3,430,018 | 2/1969 | Baird . | |
| 3,584,170 | 6/1971 | Bould . | |
| 3,603,755 | 9/1971 | Ranzanigo . | |
| 4,132,968 | 1/1979 | Lang . | |
| 4,245,140 | 1/1981 | Jencks et al. . | |
| 4,408,111 | 10/1983 | Domhan et al. . | |
| 4,459,445 | 7/1984 | Hisatsune et al. . | |
| 4,650,946 | 3/1987 | Maier et al. . | |
| 4,791,393 | 12/1988 | Flick et al. . | |
| 4,849,590 | 7/1989 | Becker et al. . | |
| 4,855,549 | 8/1989 | Toda et al. | 335/16 |
| 4,891,618 | 1/1990 | Paton . | |
| 4,999,598 | 3/1991 | Jannesari et al. . | |
| 5,004,875 | 4/1991 | Moody et al. . | |
| 5,027,096 | 6/1991 | White et al. . | |
| 5,073,764 | 12/1991 | Takahashi et al. . | |
| 5,089,795 | 2/1992 | Morgan et al. . | |

FOREIGN PATENT DOCUMENTS

| | | |
|---|---|---|
| 1141052 | 1/1969 | United Kingdom . |

*Primary Examiner*—Lincoln Donovan

*Attorney, Agent, or Firm*—Merchant, Gould, Smith, Edell, Welter & Schmidt, P.A.

[57] ABSTRACT

An electric switch includes a plurality of moveable contacts and a plurality of stationary contacts which firmly contact with the moveable contacts in a normal closed position by a spring, such as a leaf spring or a compression spring. The electric switch further includes a locking member which is disposed between two adjacent moveable contacts. When a "fault" current passes through the moveable contacts and the stationary contacts, a repulsive force is caused at the contact tips such that it tends to open the contact between the moveable and stationary contacts. The "fault" current also causes adjacent moveable contacts to attract to each other thus has tendency to open the contact. The locking member which is disposed between the neighboring moveable contacts engages with the moveable contacts so as to maintain the contact between the moveable contacts and the stationary contacts. The locking member has two oblique surfaces, one on each side, to face to the moveable contacts.

12 Claims, 10 Drawing Sheets

CATCH FOR ELECTRICAL CONTACT UTILIZING ELECTROMAGNETIC FORCES

FIELD OF THE INVENTION

The present invention relates to a catch for electrical contact utilizing electromagnetic forces, more particularly, to a catch for electrical contact used in an electric transfer switch or other types of devices, such as circuit breakers.

BACKGROUND OF THE INVENTION

In an electric switch which utilizes make and break contacts, for example, where there is a contact between moveable contacts and stationary contacts, repulsive electro dynamic forces are present due to currents flowing through these contacts. The detailed theory of the causes of generating these forces is well-known in the electric switch art.

When a "fault" current passes through the contact tips, electromagnetic repulsive forces of very high magnitude are generated at the contact tips. These forces cause the contact tips to lift from their normally closed position. The opening of the contacts ignites the electric arc with core temperatures exceeding the melting points of the moveable and stationary contacts. The contacts are thus welded and render the electric switch damaged, and in worse situations, inoperable or malfunctional. Further, when the electric transfer switch is closed, the moveable and stationary contacts will bounce and strike with each other. The bouncing and striking also cause the electric arcs and consequently cause welded contacts.

In addition, the very same "fault" current also causes the moveable contacts to attract to each other so that the moveable contacts come closer to each other. The neighboring moveable contacts will also bounce and strike with each other which cause electrical arc, and eventually the neighboring moveable contacts are welded together which render the electrical transfer switch inoperable.

Accordingly, one of the objects of an electric transfer switch is to maintain the contact between the various contacts, such as between the moveable contacts and the stationary contacts, in a normal current situation so as to eliminate the electric arc or other negative effects in damaging the contacts.

Another object is to maintain contact between the moveable contacts and the stationary contacts under a "fault" current so as to prevent the contact tips of the moveable contacts and the stationary contacts from bouncing and striking with each other.

Conventional electric switches have not been able to address the above concerns or solve these problems. U.S. Pat. No. 4,849,590 discloses a way of keeping the contacts shut. However, the disclosed invention relied on providing a small blow-off force to blow an arc into an arc chamber when the contacts separate.

U.S. Pat. No. 5,073,764 discloses a twin-contact type current limiting apparatus. However, it actually increases the contact open force by routing the current.

The present invention provides a catch for an electric transfer switch or other types of devices, such as circuit breakers, which solves these and many other problems associated with existing electric transfer switches or circuit breakers.

SUMMARY OF THE INVENTION

The present invention relates to a catch for electrical contact utilizing electromagnetic forces, more particularly, to a catch for electrical contact used in an electric transfer switch or other types of devices, such as circuit breakers.

In one embodiment, the present invention comprises a plurality of moveable contacts contacting a plurality of stationary contacts in a normal situation. Under a "fault" current, high repulsive forces are generated at contacting ends of the moveable contacts and the corresponding stationary contacts, which tend to open the contacting ends between the moveable contacts and the stationary contacts. Meanwhile, high attractive forces are generated between the neighboring moveable contacts due to a high electric current flowing in a parallel and same direction in the neighboring moveable contacts. The moveable contacts are thus attracted to each other. A locking pin is disposed between the two neighboring moveable contacts. Under a "fault" current, the attracted moveable contacts are engaged against the locking pin. The locking pin is in such a configuration as to maintain the contacts between the moveable contacts and the stationary contacts, thereby eliminating the opening of the contacting ends under a"fault" current.

Still in one embodiment, a plurality of leaf springs are used to maintain the contact between the moveable contacts and the stationary contacts. The leaf springs are further used to eliminate or reduce the bouncing and striking by absorbing energy and by offering friction on the moveable contacts. Furthermore, the leaf springs are used to cancel out the effect of repulsive force by pivoting and transmitting the force to the adjacent moveable contact.

In another embodiment, a plurality of compression springs are used to replace the leaf springs to maintain the contact between the moveable contacts and the stationary contacts.

In a third embodiment, a second plurality of leaf springs are used to replace the first plurality of leaf springs or a plurality of compression springs. The second plurality of leaf springs are biasedly connected between the body of the switch and the moveable contacts so as to force the moveable contacts maintain contact with the stationary contacts.

In an alternative embodiment, the locking pins can be replaced by a plurality of locking bars which are disposed along and between the two adjacent moveable contacts.

One particular advantage of the present invention is that it maintains the contact between the moveable contacts and the stationary contacts during both a normal situation and an abnormal situation, such as when a "fault" current passes by the contacts.

Another advantage is that the present invention uses simple and effective locking pins which counteract the repulsive electro dynamic forces.

Another advantageous feature of the present invention is that it uses simple and effective leaf springs or compression springs to help cancel out at least part of the repulsive electrodynamic forces, as well as to maintain contact between the moveable contacts and the stationary contacts in a normal closed position.

These and various other advantages and features of novelty which characterize the invention are pointed out with particularity in the claims annexed hereto and forming a part hereof. However, for a better understanding of the invention, its advantages, and objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

In the drawings, in which like reference numerals and letters generally indicate corresponding parts throughout the following several views.

DETAILED DESCRIPTION OF THE PREFERRED EMBODIMENT

Figure 1:
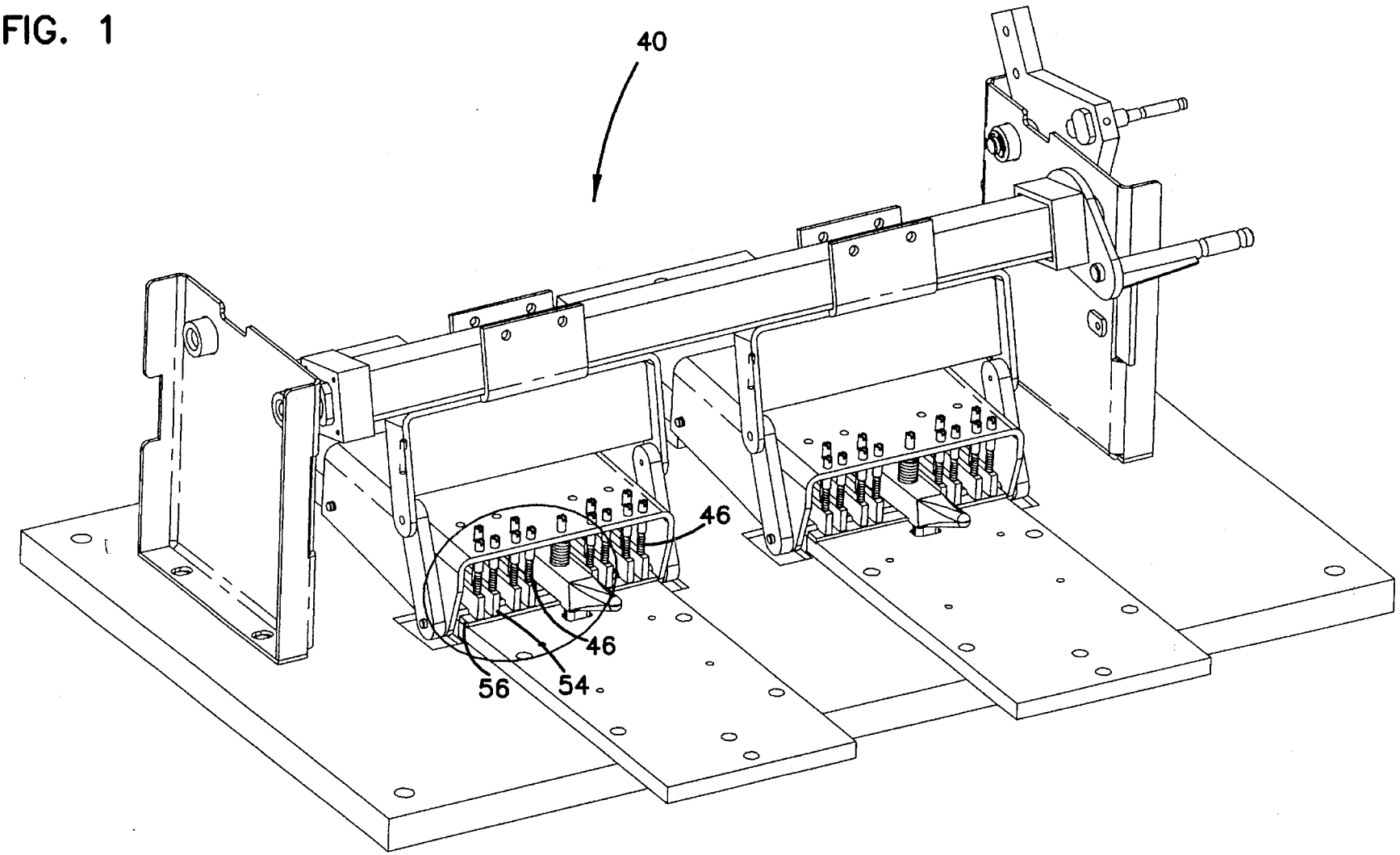
FIG. 1 is a perspective view of an embodiment of an electric transfer switch having a plurality of catches generally in accordance with the principles of the present invention.
Figure 2:
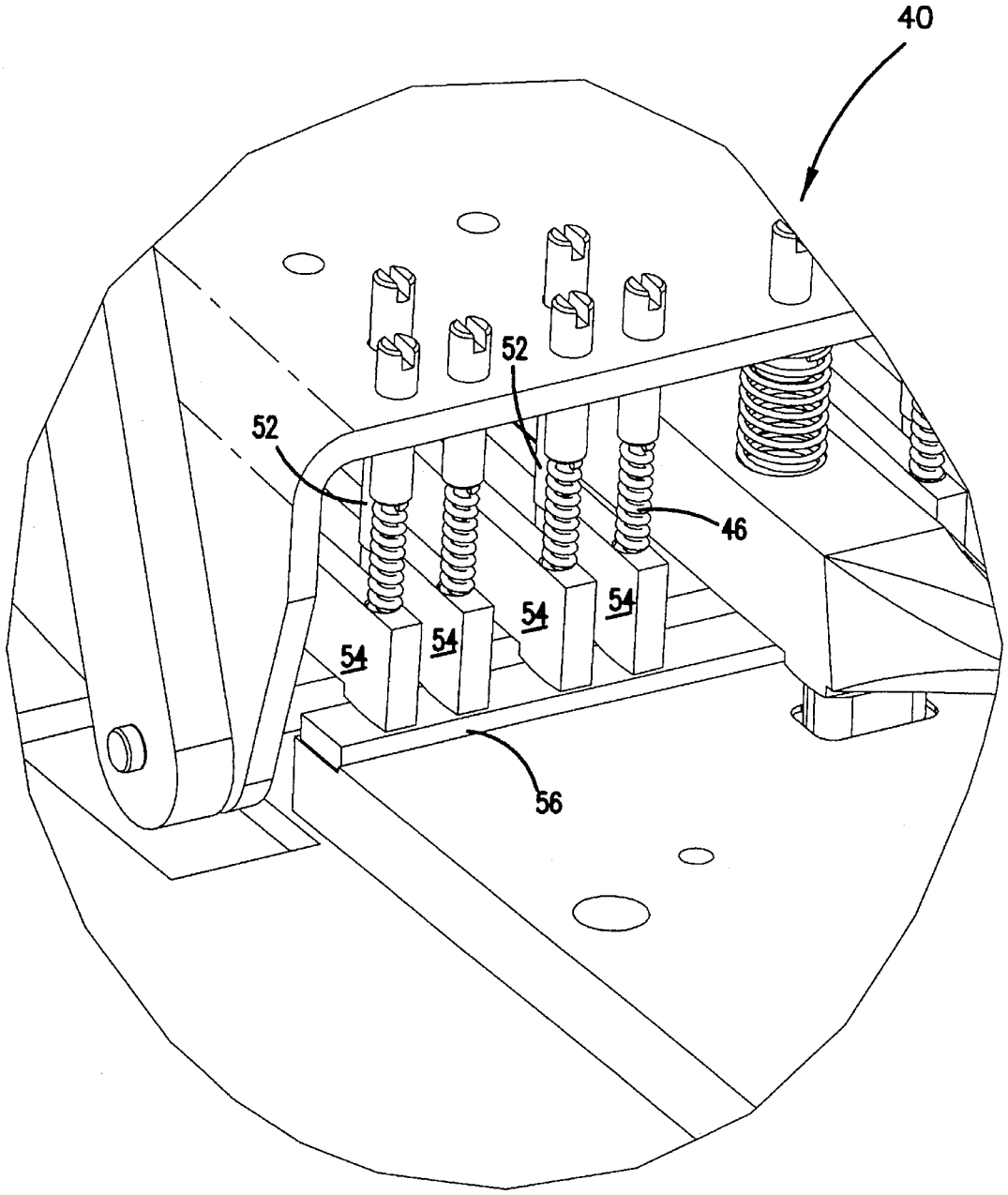
FIG. 2 is an enlarged perspective view of the embodiment shown in FIG. 1, showing moveable contacts, stationary contacts, catches, and compression springs.
Figure 3:
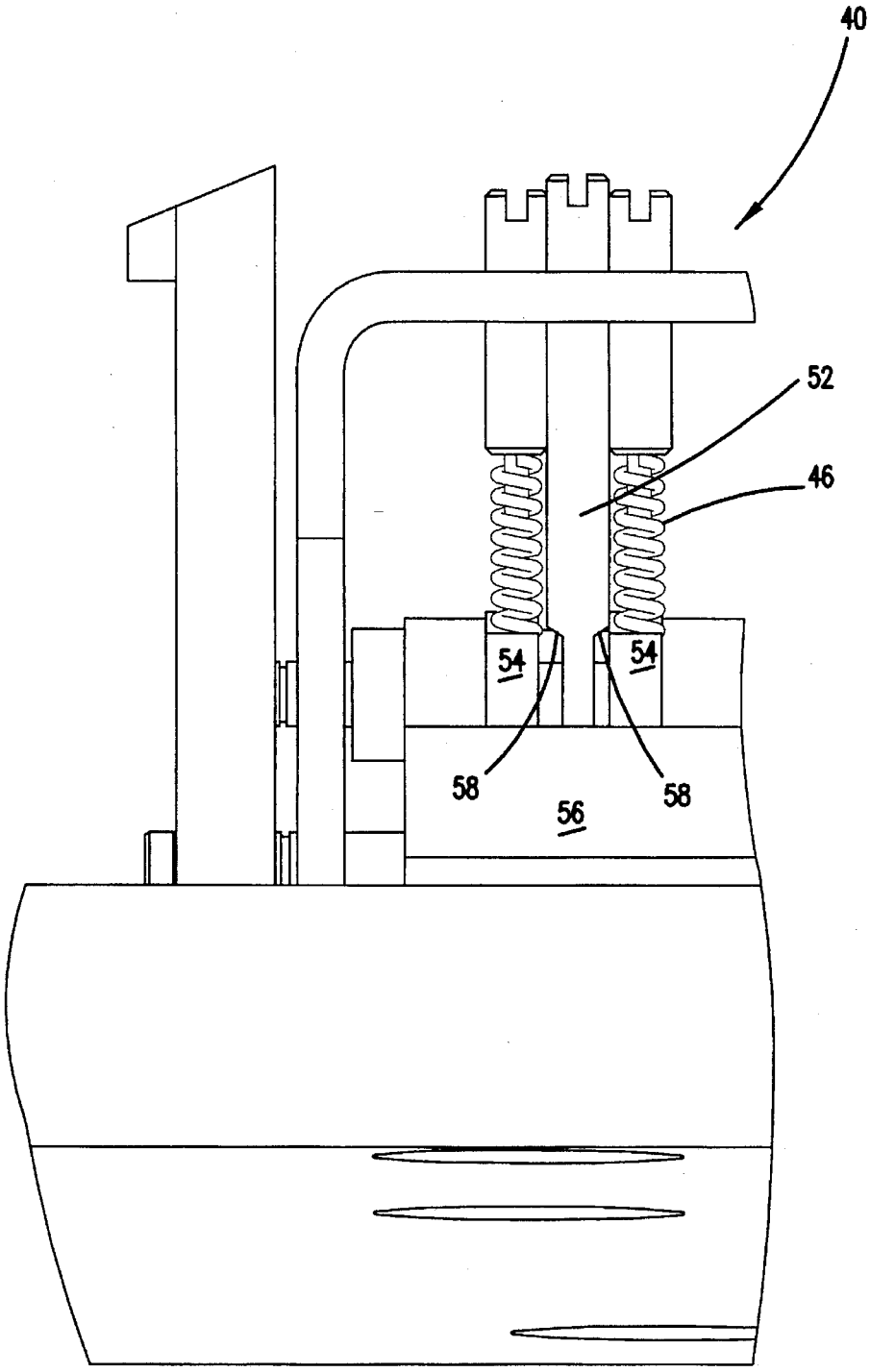
FIG. 3 is a partial front elevational view of the embodiment shown in FIG. 2 when there is no "fault" current passes by the contacts.
Figure 4:
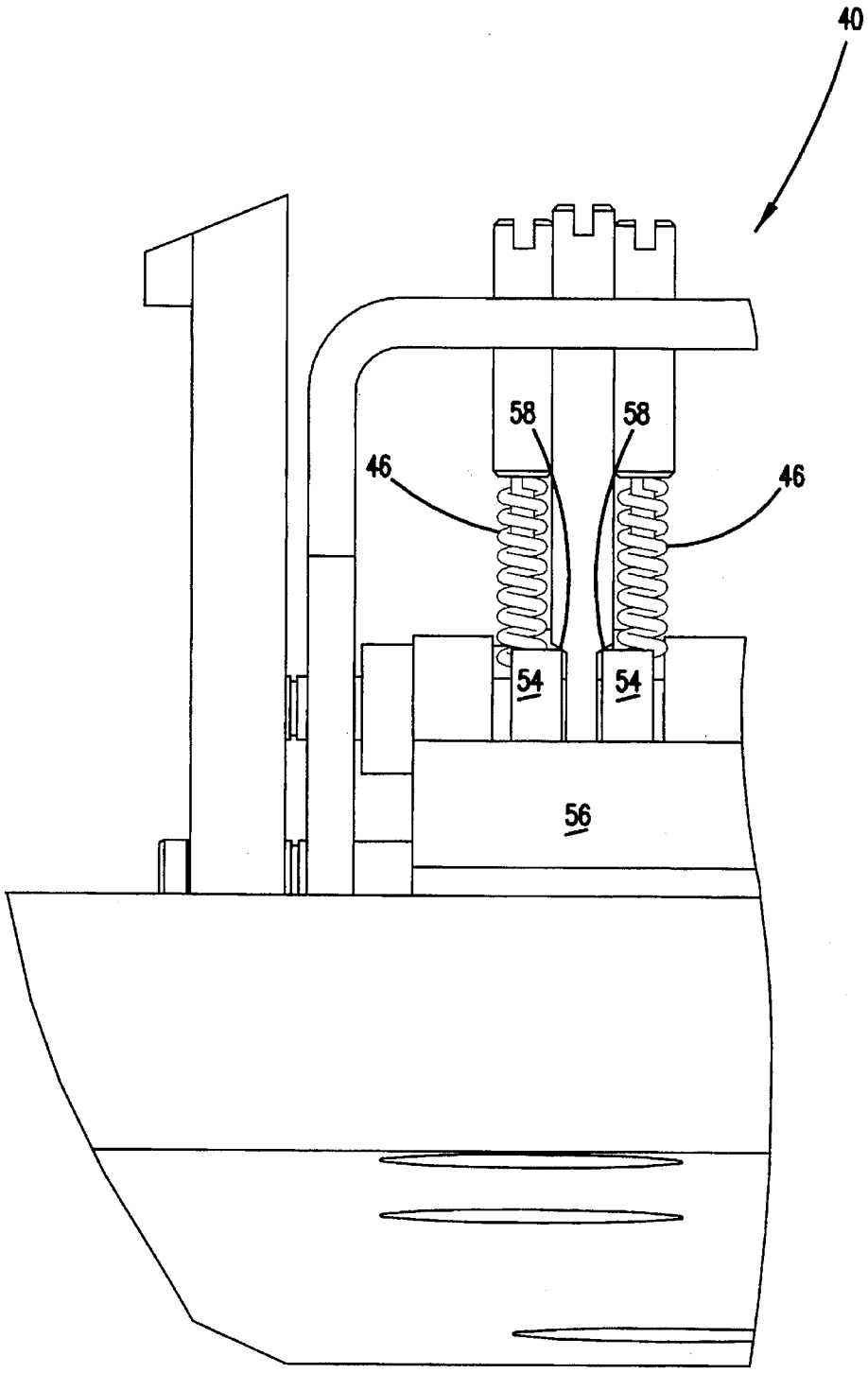
FIG. 4 is a partial front elevational view of the embodiment shown in FIG. 2 when there is a "fault" current passes by the contacts.
Figure 5:
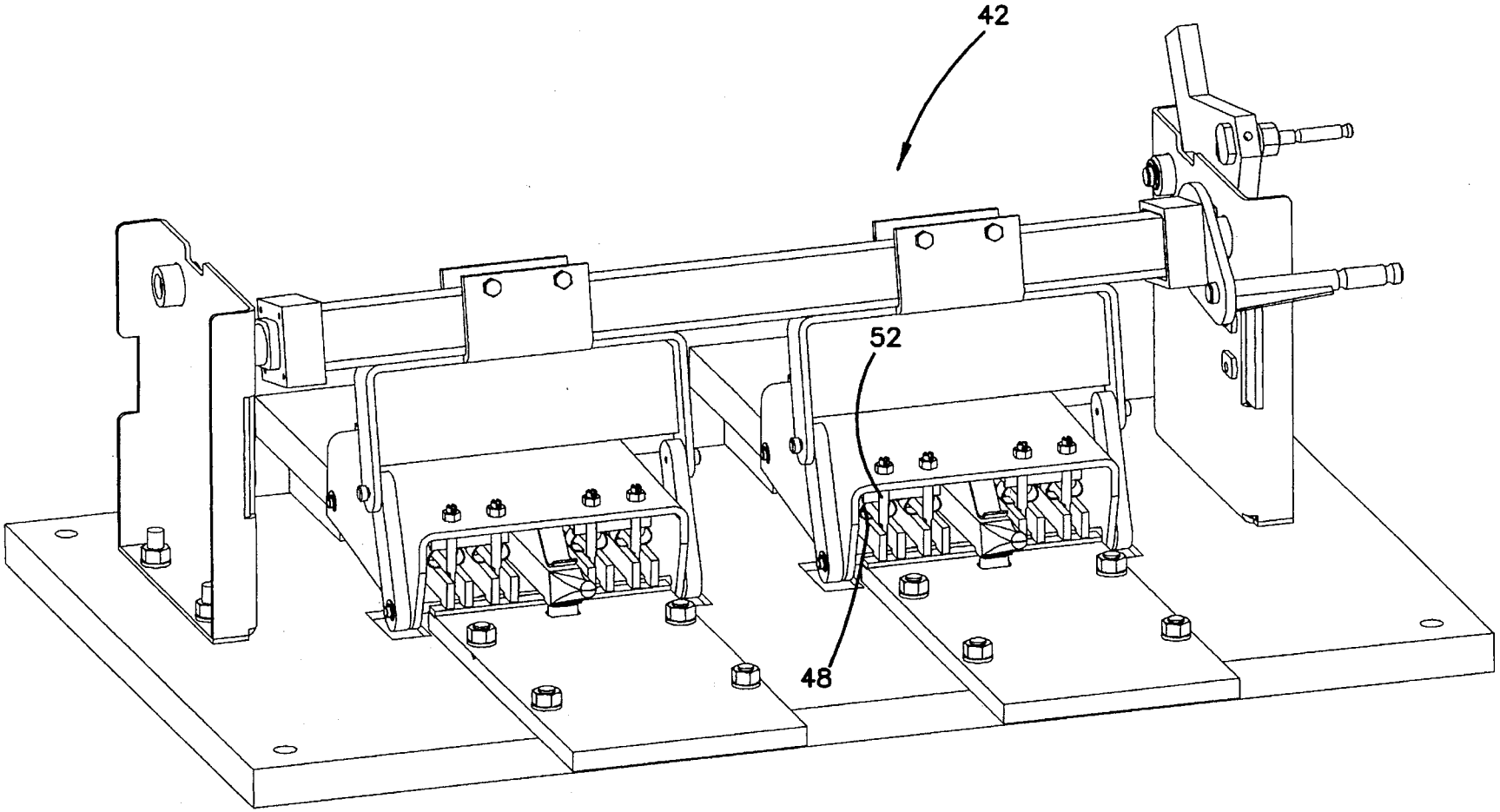
FIG. 5 ms a perspective view of a second embodiment of an electric transfer switch having a plurality of catches generally in accordance with the principles of the present invention.
Figure 6:
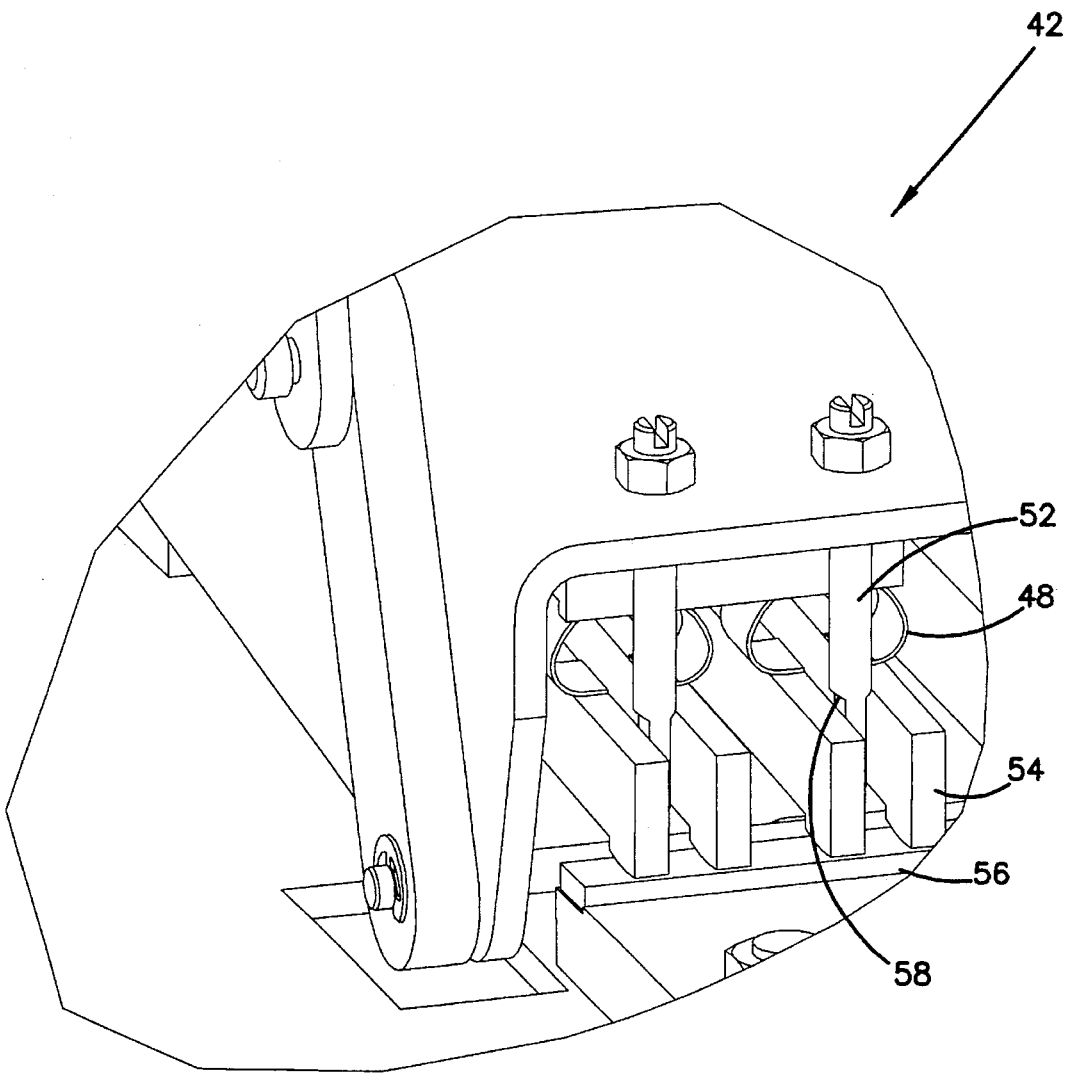
FIG. 6 is an enlarged perspective view of the second embodiment shown in FIG. 5, showing moveable contacts, stationary contacts, catches, and leaf springs.
Figure 7:
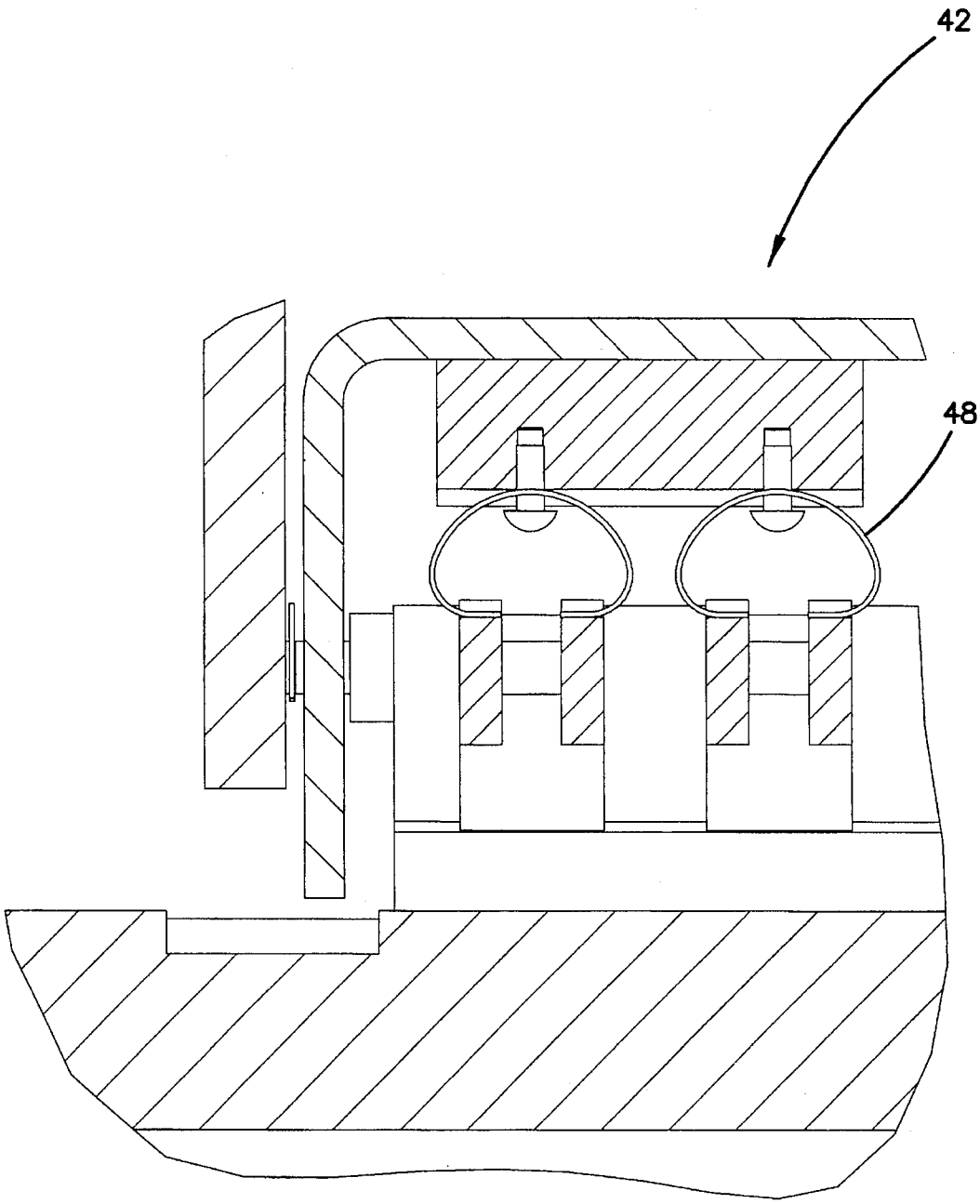
FIG. 7 is a longitudinal cross-sectional view of the second embodiment shown in FIG. 5.
Figure 8:
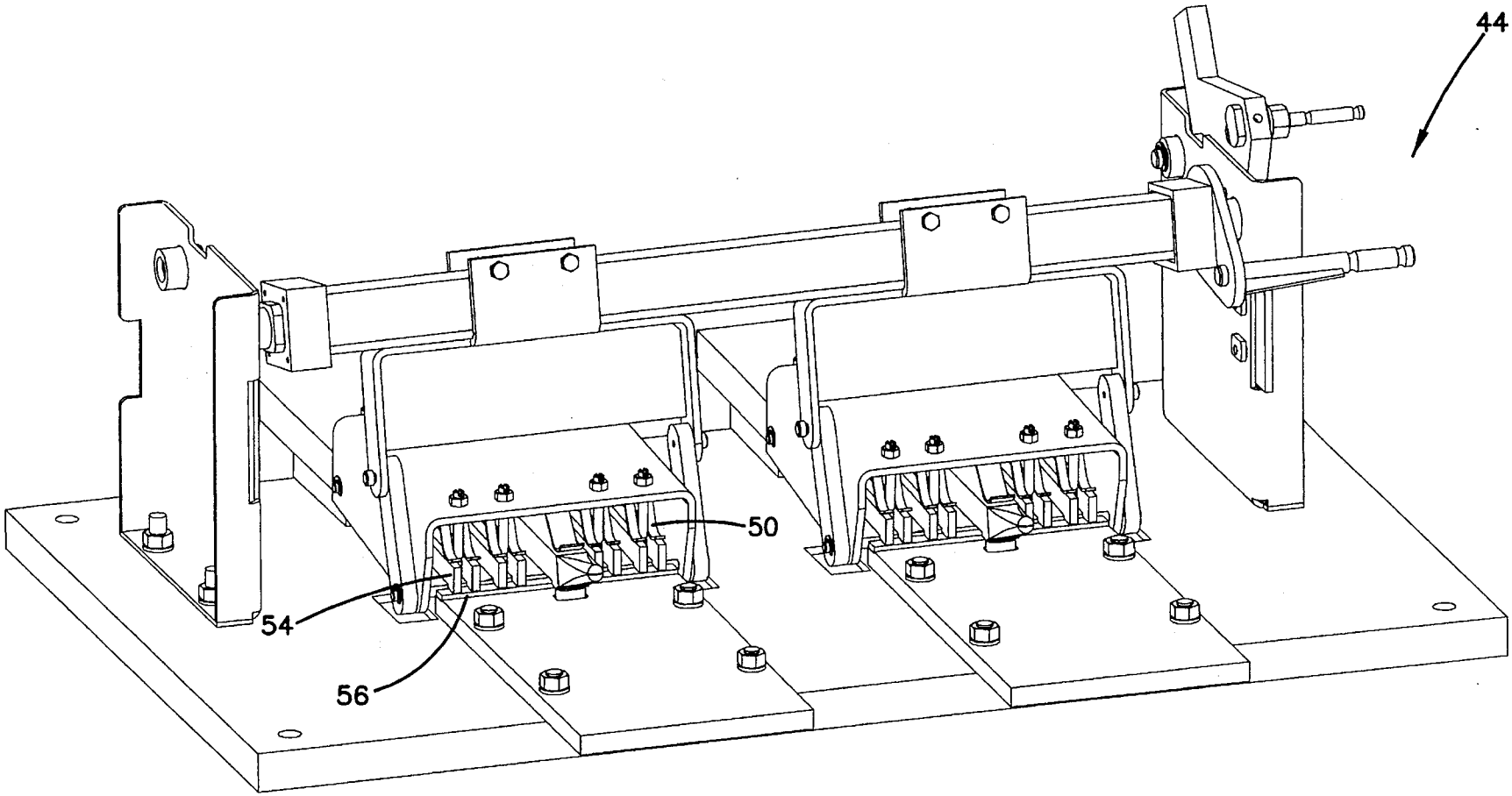
FIG. 8 is a perspective view of a third embodiment of an electric transfer switch having a plurality of catches generally in accordance with the principles of the present invention.
Figure 9:
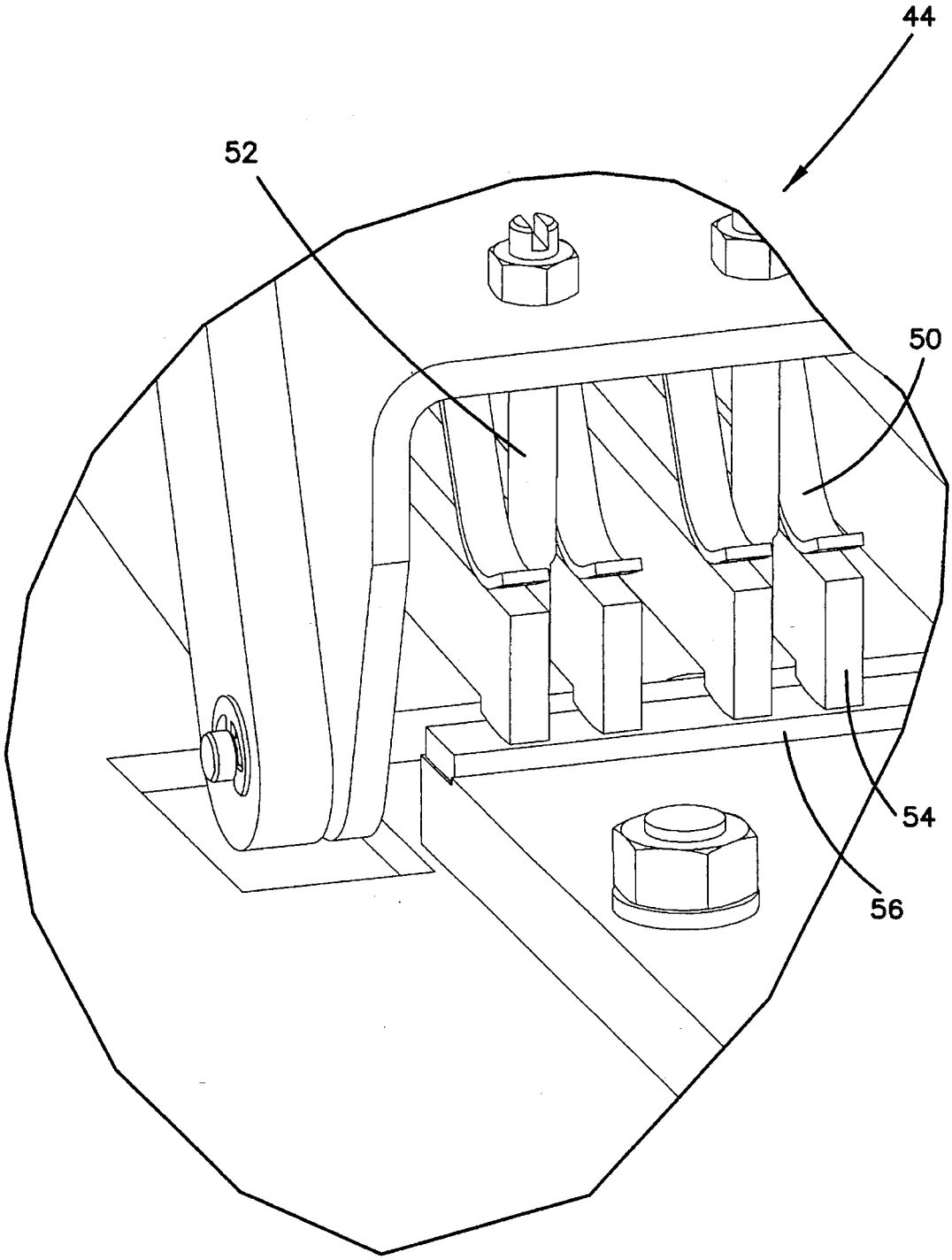
FIG. 9 is an enlarged perspective view of the third embodiment shown in FIG. 8, showing moveable contacts, stationary contacts, catches, and leaf springs.
Figure 10:
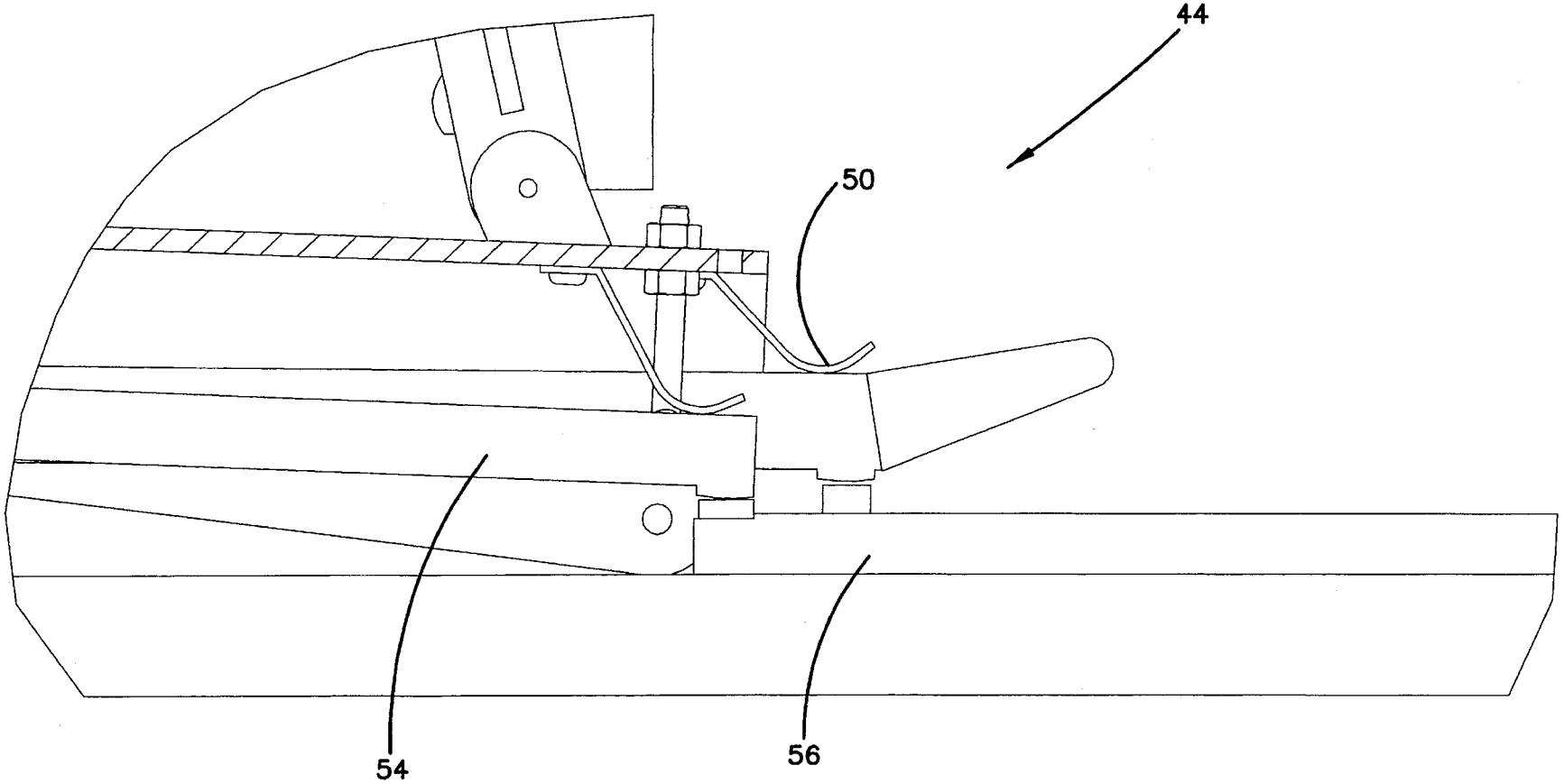
FIG. 10 is a transversal cross-sectional view of the third embodiment shown in FIG. 8.

Referring now to the drawings in details, wherein like numerals identify similar elements throughout, FIGS. 1–4 show an embodiment of an electric transfer switch 40, generally in accordance with the principles of the present invention. FIGS. 5–7 show a second embodiment of an electric transfer switch 42, and FIGS. 8–10 show a third embodiment of an electric transfer switch 44. In the first embodiment of the electric transfer switch 40, a plurality of compression springs 46 are used. In the second embodiment of the electric transfer switch 42, a plurality of leaf springs 48 replace the compression springs 46. In the third embodiment of the electric transfer switch 44, a plurality of leaf springs 50 are used to replace the compression springs 46 or the leaf springs 48.

In FIGS. 1–4, the switch 40 includes a plurality of catches 52 (or later called locking pins 52) which lock against or engage against adjacent moveable contacts 54 so as to maintain the contacts between the moveable contacts 54 and stationary contacts 56 when a "fault" current passes by the contacts 54,56.

The compression springs 46 are mounted between the body of the switch 40 and the moveable contacts 54 so as to force the moveable contacts 54 downward to contact the stationary contacts 56. Thus, any incidental disconnection between the contacts 54 and 56 is prevented. Further, the compression springs 46 help maintain the contact between the moveable contacts 54 and the stationary contacts 56 in place when a "fault" current passes by the contacts.

FIG. 3 shows the switch 40 when there is no "fault" current passes by the contacts 54,56. The locking pin 52 is disposed between two neighboring moveable contacts 54. The locking pin 52 has two oblique surfaces 58 on each side of the locking pin 52. The oblique surfaces 58 are engaged by the moveable contacts 54 when there is a "fault" current passes by the contacts 54,56, as shown in FIG. 4. When there is a "fault" current, the repulsive forces tend to cause the moveable contacts 54 to separate from the stationary contacts 56. Meanwhile, because of the "fault" current, the moveable contacts 54 are magnetically attracted to each other so that the moveable contacts 54 are engaged on the oblique surfaces 58 of the locking pin 52. The oblique surfaces 58 force the moveable contacts 54 down so as to maintain the contact even when there is a "fault" current. The compression springs 46 balance out only a small part of the repulsive forces caused by the "fault" current. Without the locking pin 52, the moveable contacts 54 would disconnect from the stationary contacts 56. With the locking pin 52, the oblique surfaces 58 of the locking pin 52 lines up the top surface of the moveable contacts 54 so as to stop the moveable contacts 54 from disconnecting from the stationary contacts 56. Therefore, the moveable contacts 54 are "caught" by the locking pin 52.

It is appreciated that other types of catches can be used to function as the locking pins 52.

As shown in FIG. 3, one end of the compression spring 46 is connected to the body of the switch 40, and the other end of the compression spring 46 is connected to the moveable contacts 54. The compression springs 46 are normally compressed so as to force the moveable contracts 54 downwards to tightly contact the stationary contacts 56.

FIGS. 5–7 show the second embodiment of the switch 42. The leaf springs 48 replace the compression springs 46. The leaf springs 48 has a horizontal "C" shape. The leaf spring 48 bridges between two neighboring moveable contacts 54 where one end portion of the leaf spring 48 is connected to the top surface of one moveable contact 54, and the other end portion of the leaf spring 48 is biasedly connected to the top surface of the neighboring moveable contact 54. The middle portion of the leaf spring 48 is mounted on the body of the switch 42 by screws or other type of mounting device, as shown in FIG. 7. The leaf springs 48 force the moveable contacts 54 downward to contact the stationary contacts 56 in a normal operation. When there is a "fault" current passing by the contacts 54,56, the leaf springs 48 will help balance out some part of the repulsive forces caused by the "fault" current. Once again, the locking pins 52 maintain the contact between the moveable contacts 54 and the stationary contacts 56 when there is a "fault" current.

FIGS. 8–10 show the third embodiment of the switch 44. The leaf springs 50 replace the compression springs 46 or the leaf springs 48. The leaf spring 50 has a substantial "Z" shape and includes a mounting end portion which mounts on the body of the switch 44, and a leg portion which biasedly connects to the top surface of the moveable contact 54, as shown in FIG. 10. The leaf springs 50 force the moveable contacts 54 downward to contact the stationary contacts 56 in a normal operation. When there is a "fault" current passing by the contacts 54,56, the leaf springs 50 will help balance out some part of the repulsive forces caused by the "fault" current. Again, the locking pins 52 maintain the contact between the moveable contacts 54 and the stationary contacts 56 when there is a "fault" current.

As further shown in FIGS. 1–10. The locking pins 52 having two ends which are mounted on the body of the switch 40, 42, 44.

It is appreciated that this type of electromagnetic catch can be used in different types of electric switches, such as different types of electric transfer switches for switching the moveable contacts among different power supplies, e.g., among a normal main power supply, a standby emergency power supply, and a neutral non-power line.

It will be appreciated that alternate embodiments in keeping with the principles of the present invention might be utilized. It is to be understood, however, that even though numerous characteristics and advantages of the invention have been set forth in the foregoing description, together with details of the structure and function of the invention, the disclosure is illustrative only, and changes may be made in detail, especially in matters of shape, size and arrangement of parts, within the principles of the invention, to the full extent indicated by the broad general meaning of the terms in which the appended claims are expressed.

What is claimed is:

1. An electric switch, comprising:

a plurality of moveable contacts;

a plurality of stationary contacts which are contacted by the moveable contacts in a closed position; and a plurality of locking pins, each locking pin being disposed between each of two adjacent moveable contacts, the locking pin being spaced apart from the moveable contacts in a normal closed position, the locking pin being engaged by the two adjacent moveable contacts when a "fault" current passes through the moveable contacts and the stationary contacts.

2. An electric switch in accordance with claim 1, wherein the locking pin has an oblique surface on each side, when the "fault" current passes by, the moveable contacts attracting to each other and engaging with the two adjacent moveable contacts, a top surface of each of the two adjacent moveable contacts engages with each oblique surface of the locking pin, so that the locking pin forces the moveable contacts downward to maintain contact between the moveable contacts and the stationary contacts.

3. An electric switch in accordance with claim 1, further comprising a spring which forces the moveable contacts downward to contact the stationary contacts in the normal closed position and which balances out a part of repulsive forces caused by the "fault" current, one end of the spring is connected to the moveable contacts.

4. An electric switch in accordance with claim 3, wherein the spring is a compression spring, one end of the compression spring is connected to a body of the switch, and the other end of the compression spring is connected to a top surface of the moveable contacts.

5. An electric switch in accordance with claim 3, wherein the spring is a leaf spring, the leaf spring includes two leg end portions and a middle portion, a first leg end portion is biasedly connected to one of the moveable contacts, the other leg end portion is biasedly connected to a neighboring moveable contact, the middle portion is mounted onto a body of the switch.

6. An electric switch in accordance with claim 3, wherein the spring is a second leaf spring, a first end of the second leaf spring is biasedly connected to a top surface of each of the moveable contacts, and a second end of the second leaf spring is mounted to a body of the switch.

7. A catch for an electric transfer switch or circuit breaker or the like, comprising:

at least two moveable members;

at least one stationary member which is contacted by the two moveable members; and a locking member being disposed between the moveable members, the locking member locking the moveable members to maintain contact between the moveable members and the stationary member when a "fault" current causes the moveable members to separate from the stationary member.

8. A catch in accordance with claim 7, wherein the locking member is a locking pin, the locking pin has two oblique surfaces on each side, when the "fault" current passes by, the moveable members attracting to each other and engaging with the two oblique surfaces to force the moveable members down toward the stationary member so that the moveable members and the stationary members maintain contact with each other in a closed position.

9. A catch in accordance With claim 7, wherein each of the moveable members is firmly contacted to each of the stationary members by a spring in a normal closed position, the spring also balances out a part of the repulsive force when the "fault" current passes by the moveable members and the stationary members.

10. A catch in accordance with claim 9, wherein the spring is a compression spring, one end of the compression spring is connected to a body of the switch, and the other end of the compression spring is connected to a top surface of the moveable contacts.

11. A catch in accordance With claim 9, wherein the spring is a leaf spring, the leaf spring includes two leg end portions, a first leg end portion is biasedly connected to one of the moveable contacts, the other leg end portion is biasedly connected to a neighboring moveable contact.

12. A catch in accordance with claim 9, wherein the spring is a second leaf spring, a first end of the second leaf spring is biasedly connected to a top surface of each of the moveable contacts.

* * * * *